US008275303B2

(12) United States Patent
Yoo

(10) Patent No.: US 8,275,303 B2
(45) Date of Patent: Sep. 25, 2012

(54) DISCHARGING UNIT AND IMAGE FORMING APPARATUS HAVING THE SAME

(75) Inventor: Jae-seok Yoo, Suwon-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 817 days.

(21) Appl. No.: 12/018,971

(22) Filed: Jan. 24, 2008

(65) Prior Publication Data

US 2008/0310899 A1 Dec. 18, 2008

(30) Foreign Application Priority Data

Jun. 12, 2007 (KR) ..... 10-2007-0057473

(51) Int. Cl.
*G03G 15/00* (2006.01)
*B65H 31/04* (2006.01)

(52) U.S. Cl. ..... 399/405; 271/292; 271/293

(58) Field of Classification Search ..... 399/361, 399/363, 381, 405, 406, 407; *B65H 31/04*
See application file for complete search history.

(56) References Cited

U.S. PATENT DOCUMENTS

| | | | | |
|---|---|---|---|---|
| 7,748,705 | B2 * | 7/2010 | Yamada | 271/209 |
| 2005/0201794 | A1 * | 9/2005 | Suzuki | 399/405 |

FOREIGN PATENT DOCUMENTS

| | | | |
|---|---|---|---|
| JP | 63041350 A | * | 2/1988 |
| JP | 04085260 A | * | 3/1992 |
| JP | 04144878 A | * | 5/1992 |
| JP | 05105305 A | * | 4/1993 |
| JP | 08034557 A | * | 2/1996 |
| JP | 09142713 A | * | 6/1997 |
| JP | 2002193527 A | * | 7/2002 |
| JP | 2002308509 A | * | 10/2002 |

OTHER PUBLICATIONS

Official Translation of JP 04085260 A, by The Mcelroy Translation Company, Apr. 2012.*

* cited by examiner

*Primary Examiner* — Judy Nguyen
*Assistant Examiner* — Nguyen Q Ha
(74) *Attorney, Agent, or Firm* — Staas & Halsey LLP

(57) ABSTRACT

A discharging unit including: a casing; a discharger to discharge printing medium; a storage plate disposed in the casing below the discharger, to store the printing media discharged by the discharger; and a separation preventing unit to prevent the printing media from being ejected from the discharging unit by selectively protruding from the storage plate.

12 Claims, 6 Drawing Sheets

DISCHARGING UNIT AND IMAGE FORMING APPARATUS HAVING THE SAME

CROSS-REFERENCE TO RELATED APPLICATION

This application claims the benefit of Korean Application No. 2007-57473, filed Jun. 12, 2007, in the Korean Intellectual Property Office, the disclosure of which is incorporated herein by reference.

BACKGROUND OF THE INVENTION

1. Field of the Invention

Aspects of the present invention relate to a discharging unit and an image forming apparatus having the same.

2. Description of the Related Art

Generally, an image forming apparatus is connected with a host device and forms an image on a printing medium, with image data supplied from the host device. An image forming apparatus can be a printer that prints image data on a printing medium, a fax machine that transmits image data to a separate reception facsimile, a scanner that scans a document and generates image data, a photocopier that copies image data to a printing medium, and a multi-function peripheral (MFP) that is a combination of the aforementioned devices. Multi-function peripherals have been increasingly used, since such devices often include e-mail transmission and immediate web image printing functionalities, and recent wired and wireless communication technology.

FIG. 1 is a schematic view of a conventional multi-function peripheral (MFP) 10. As shown therein, the conventional multi-function peripheral 10 includes: an image forming unit 20, which forms an image on printing media; a storage unit 40, which stores the printing media on which the image is formed; and a scanning unit 50, which scans a document.

In the conventional multi-function peripheral 10, a storage plate 43 of the storage unit 40 is inclined at a predetermined angle θ, to be higher than a discharger 41. Such a configuration prevents a first printing medium from being ejected from the storage plate 43, or being scattered due to a second printing medium pushing a rear edge of the first stored printing medium, with its front edge. If the storage plate 43 is lower than the discharger 41, sheets of the printing media are curled and may interact with one another on the storage plate 43. In this case, the printing media is not properly registered in the storage plate 43 and may be ejected to the outside, or scattered.

The conventional multi-function peripheral 10 includes the scanning unit 50, which is provided above the storage unit 40, and thus, a storage space to store the printing medium is limited to a height h1, between the storage plate 43 and the scanning unit 50. If the storage plate 43 is inclined, to prevent the printing media from being ejected and scattered, the size of the storage space is reduced. Particularly, if the overall height of the multi-function peripheral 10 is reduced, the storage space to store the printing media is even further reduced.

SUMMARY OF THE INVENTION

Accordingly, it is an aspect of the present invention to provide a discharging unit, which efficiently prevents printing media from being ejected, and stores a comparatively large amount of printing media, even if a storage space of a printing media is small, and an image forming apparatus having the same.

The foregoing and/or other aspects of the present invention can be achieved by providing a discharging unit, which discharges a printing medium. The discharging unit includes: a casing; a discharger to discharge the printing media; a storage plate, which is positioned below the discharger in the casing, and stores the printing media discharged from the discharger; and a separation preventing unit, which is extendable from an end part of the storage plate, and prevents the printing media discharged from the discharger from being ejected from the storage plate.

According to an aspect of the invention, the separation preventing unit includes: a separation preventing wing, which is coupled with the storage plate, and is extendable from the storage plate; and an elastic member, which is provided between the casing and the separation preventing wing, to elastically adjust a protrusion level of the separation preventing wing, with respect to the storage plate, according to a weight of the stored printing media.

According to an aspect of the invention, the separation preventing wing includes an inclination surface, which guides the printing media discharged from the discharger to an internal part of the storage plate.

According to an aspect of the invention, a maximum height of the inclination surface, with respect to the storage plate, is higher than a height of the discharger, with respect to the storage plate.

The foregoing and/or other aspects of the present invention can be achieved by providing an image forming apparatus, including: a paper feeding unit, which supplies printing media; an image forming unit, which forms images on the printing media; and a discharging unit, which discharges the printing media having the images thereon, to the outside. The discharging unit includes: a casing, which includes a discharger to discharge the printing media; a storage plate, which is positioned below the discharger in the casing, to store the printing media discharged from the discharger; and a separation preventing unit, which is capable of protruding from an end part of the storage plate, and prevents the discharged printing media from being ejected from the discharger.

According to an aspect of the invention, the separation preventing unit includes a separation preventing wing that is coupled with the storage plate and is extendable from the storage plate, and an elastic member, which is provided between the casing and the separation preventing wing and to elastically adjust a protrusion level of the separation preventing wing, with respect to the storage plate, according to a weight of the stored printing media.

According to an aspect of the invention, the separation preventing wing includes an inclination surface, which guides the printing media discharged from the discharger to an internal part of the storage plate.

According to an aspect of the invention, a maximum height of the inclination surface is higher than a height of the discharger, with respect to the storage plate.

According to an aspect of the invention, the image forming apparatus further includes at least one of: a scanning unit, which is provided on the discharging unit and scans a document to generate image data; and a copy unit, which transcribes the image data onto the printing media.

Additional aspects and/or advantages of the invention will be set forth, in part, in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the exemplary embodiments, taken in conjunction with the accompanying drawings, of which.

DETAILED DESCRIPTION OF THE EXEMPLARY EMBODIMENTS

Figure 1:
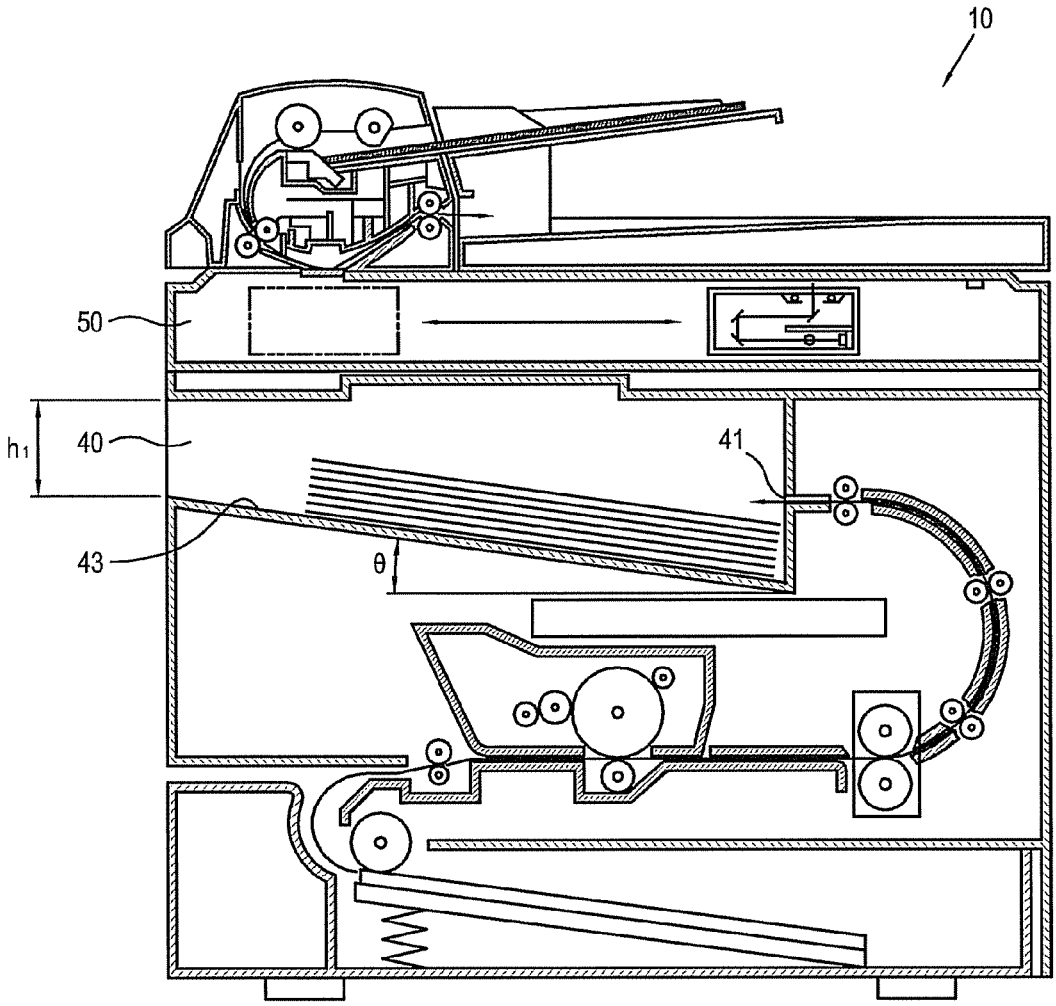
FIG. 1 (RELATED ART)
FIG. 1 is a schematic sectional view of a conventional image forming apparatus.

Reference will now be made in detail to the exemplary embodiments of the present invention, examples of which are illustrated in the accompanying drawings, wherein like reference numerals refer to the like elements throughout. The embodiments are described below, in order to explain the aspects of present invention, by referring to the figures.

Figure 2:
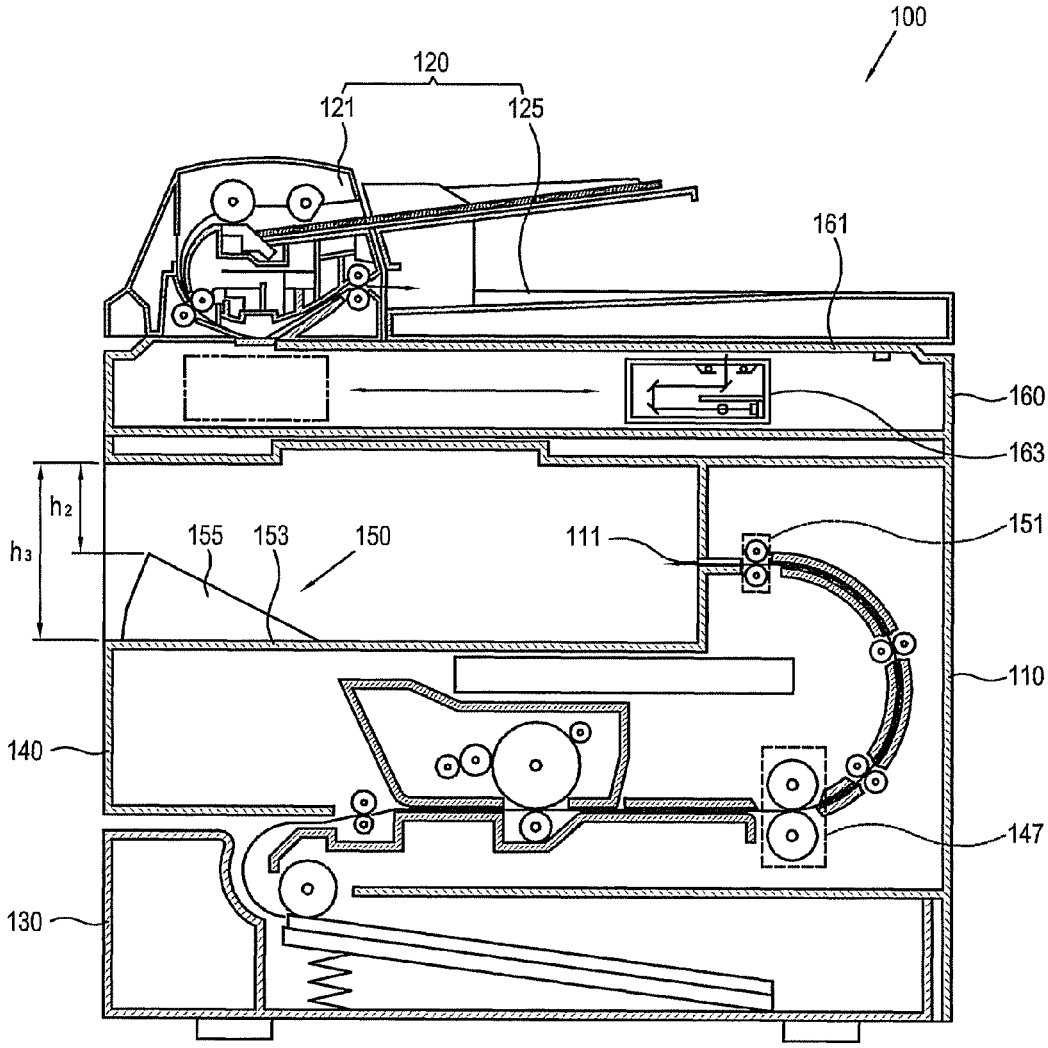
FIG. 2 is a schematic sectional view of an image forming apparatus, according to an exemplary embodiment of the present invention.

FIG. 2 is a schematic sectional view of an image forming apparatus 100, according to an exemplary embodiment of the present invention. As shown therein, the image forming apparatus 100 includes: a casing 110; a bed 120, which is provided on the casing 110 and opens and closes a stage glass 161 on the casing 110; a paper feeding unit 130, which supplies stored printing media to an image forming unit 140, which forms images on the printing media; and a discharging unit 150, which discharges the printing media having the images thereon. The image forming apparatus 100 further includes a scanning unit 160, which scans a document and generates image data.

Herein, a "printing medium" or "printing media" refers to any printable medium, for example, paper, transparency sheets, or the like. Additionally, when a first element is said to be "disposed" on a second element, the first element can directly contact the second element, or one or more other elements can be located therebetween.

Figure 5A:
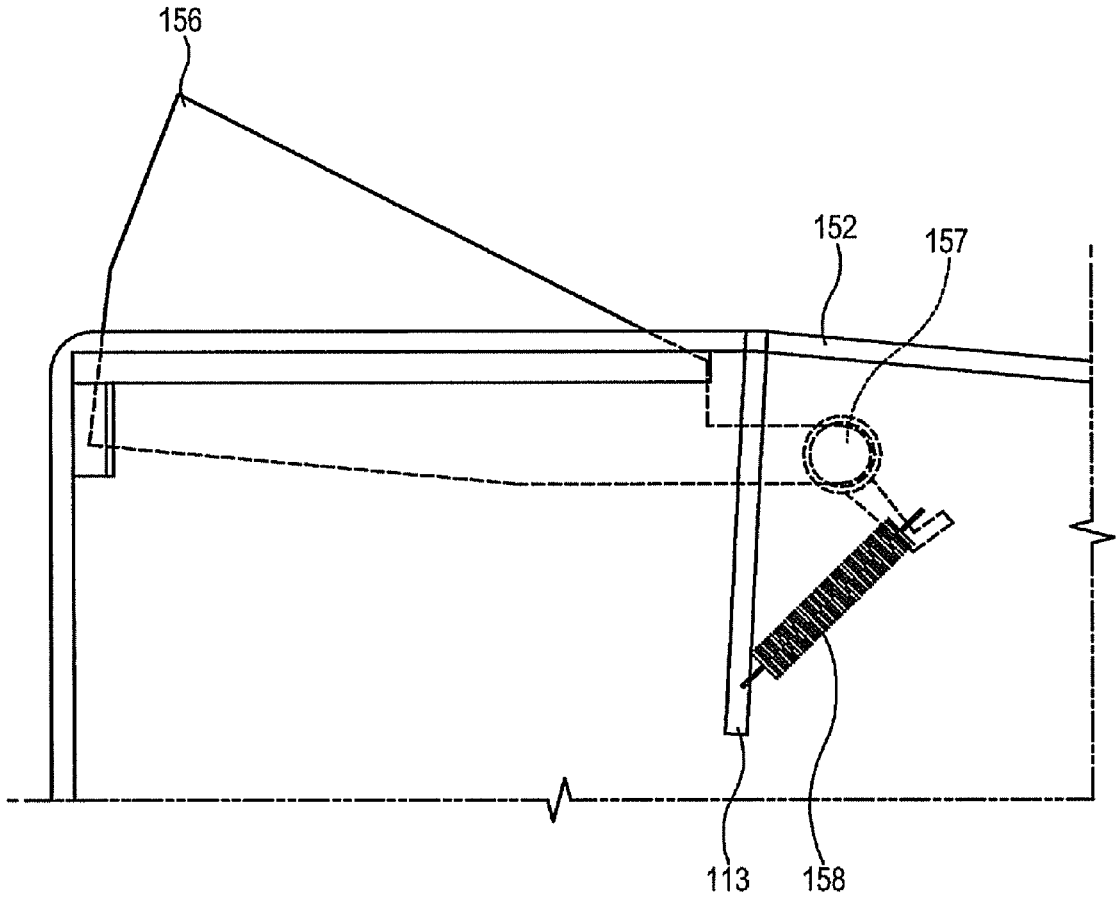
FIGS. 5A and 5B illustrate an operation of the separation preventing unit, according to an exemplary embodiment of the present invention.
Figure 5B:
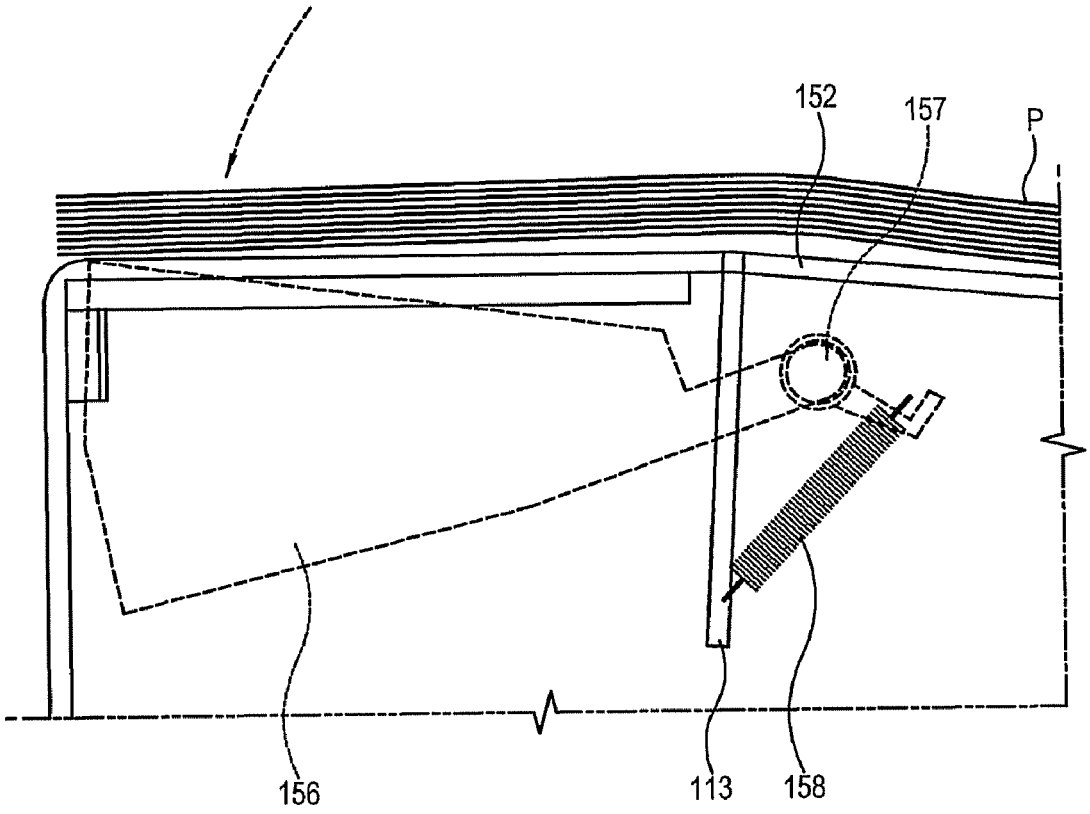

The casing 110 accommodates and supports the paper feeding unit 130, the image forming unit 140, and the discharging unit 150. The discharging unit 150 includes: a discharger 111, which discharges the printing media having the images to the outside; and an elastic member coupler 113, which supports an elastic member 158 of a separation preventing unit 155. The discharger 111 is provided on a lateral side of a discharging roller 151 and discharges the printing media having the images, to a storage plate 152. As shown in FIGS. 5A and 5B, the elastic member coupler 113 supports the elastic member 158, to allow a separation preventing wing 156 rotate. The elastic member coupler 113 may correspond to a shape and a size of the elastic member 158.

The bed 120 is provided on the casing 110 and covers the stage glass 161. The bed 120 opens to allow a document to be place on the stage glass 161 and covers the stage glass 161 when an image sensor 163 scans the document. The bed 120 may further include an automatic paper feeding unit 121, which automatically supplies the document to the scanning unit 160, and a document storage unit 125, which stores the document.

The configuration of the bed 120 is known, and a detailed description thereof will be omitted. The paper feeding unit 130 is detachably attached to a lateral side of the casing 110 and supplies the printing media to the image forming unit 140. Multiple paper feeding units 130 may be provided, without departing from the scope of the present teachings.

The image forming unit 140 forms images on the printing media supplied by the paper feeding unit 130. The image forming unit 140 may form images on the printing media, according to image data transmitted from a host device (not shown), for example, a printing signal from the host device, or may form images on the printing media with the image data generated by the scanning unit 160.

The image forming unit 140 may be an electro-photographic unit, which uses a developer, an inkjet unit, which uses an ink, or a thermo-electronic unit, which uses an ink ribbon. The image forming unit 140 can be the electro-photographic unit, which applies a developer to the printing media and uses a potential difference to form an image.

The discharging unit 150 discharges the printing media, having the images formed by the image forming unit 140, to the outside. The discharging unit 150 includes: the discharging roller 151, which guides the printing media to the discharger 111; the storage plate 152, which stores the printing media discharged by the discharging roller 151; and the separation preventing unit 155, which prevents the printing media discharged to the storage plate 152 from being ejected to the outside.

The discharging roller 151 is provided between the image forming unit 140 and the discharger 111, and guides the printing media to the storage plate 152. A plurality of the discharging rollers 151 may be provided, depending on the shape and length of a medium path between the image forming unit 140 and the discharger 111. The discharging roller 151 includes a plurality of rollers facing each other. The plurality of rollers can cross each other, to enhance the movement of the printing media.

Figure 3:
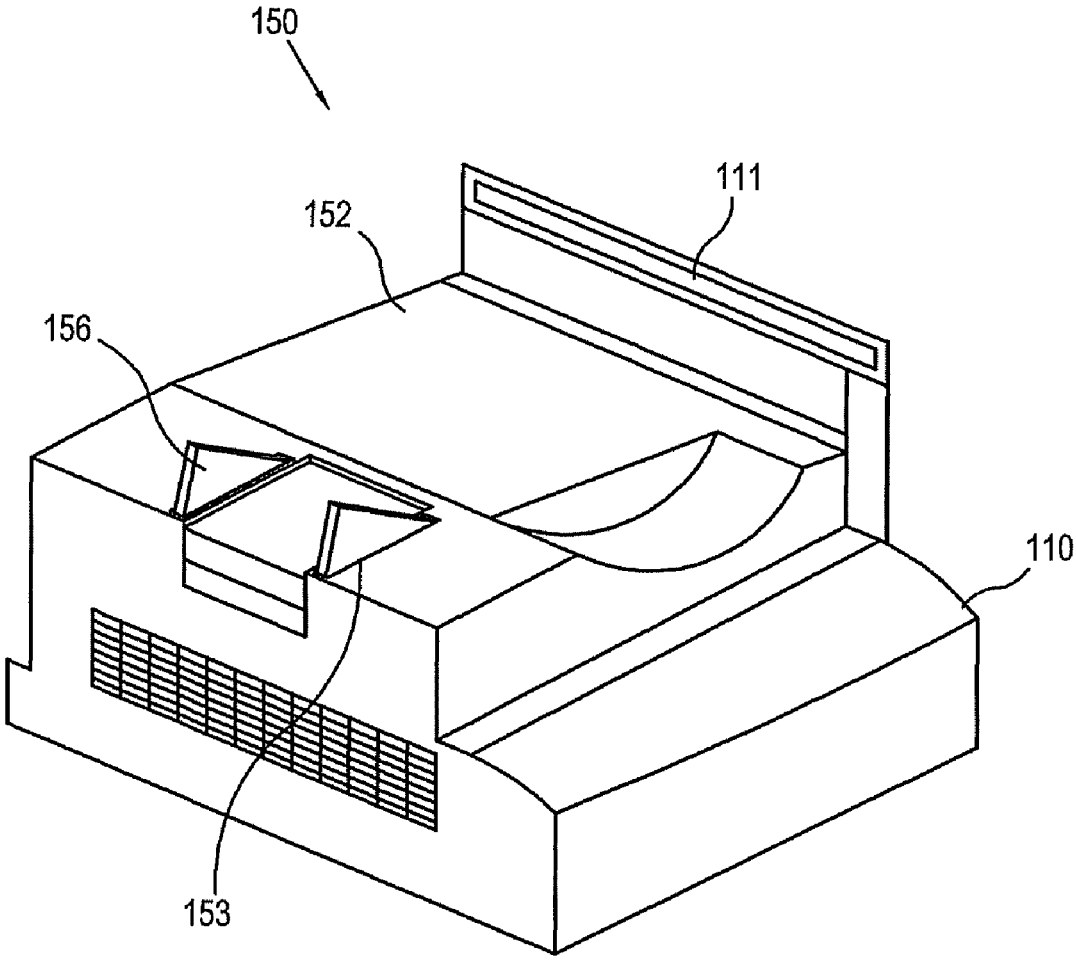
FIG. 3 is a perspective view of a discharging unit according to an exemplary embodiment of the present invention.

As shown in FIG. 3, the storage plate 152 is positioned below the discharger 111. Typically, the storage plate 152 is integrally formed in a lateral side of the casing 110, or coupled to the casing 110. The scanning unit 160 is provided on the storage plate 152, and the printing media is stored in a space formed between the storage plate 152 and the scanning unit 160.

The storage plate 152 includes an opening 153 through which the separation preventing wing 156 protrudes and withdraws. The opening 153 is generally larger than the size of the separation preventing wing 156, so as not to interfere with the movement of the separation preventing wing 156. Although two separation preventing wings 156 are shown, the present teaching are not limited thereto, as any suitable number of separation preventing wings 156 can be used.

The separation preventing unit 155 is capable of protruding from the storage plate 152 and prevents the printing media discharged from the discharger 111, from being ejected to the outside. The separation preventing unit 155 is provided in an end part of the storage plate 152, facing the discharger 111. The separation preventing unit 155 prevents the printing media discharged from the discharger 111 from being ejected to the outside. That is, as the separation preventing unit 155 prevents the discharged printing media from being ejected out of the storage plate 152, by protruding through the storage plate 152.

Figure 4:
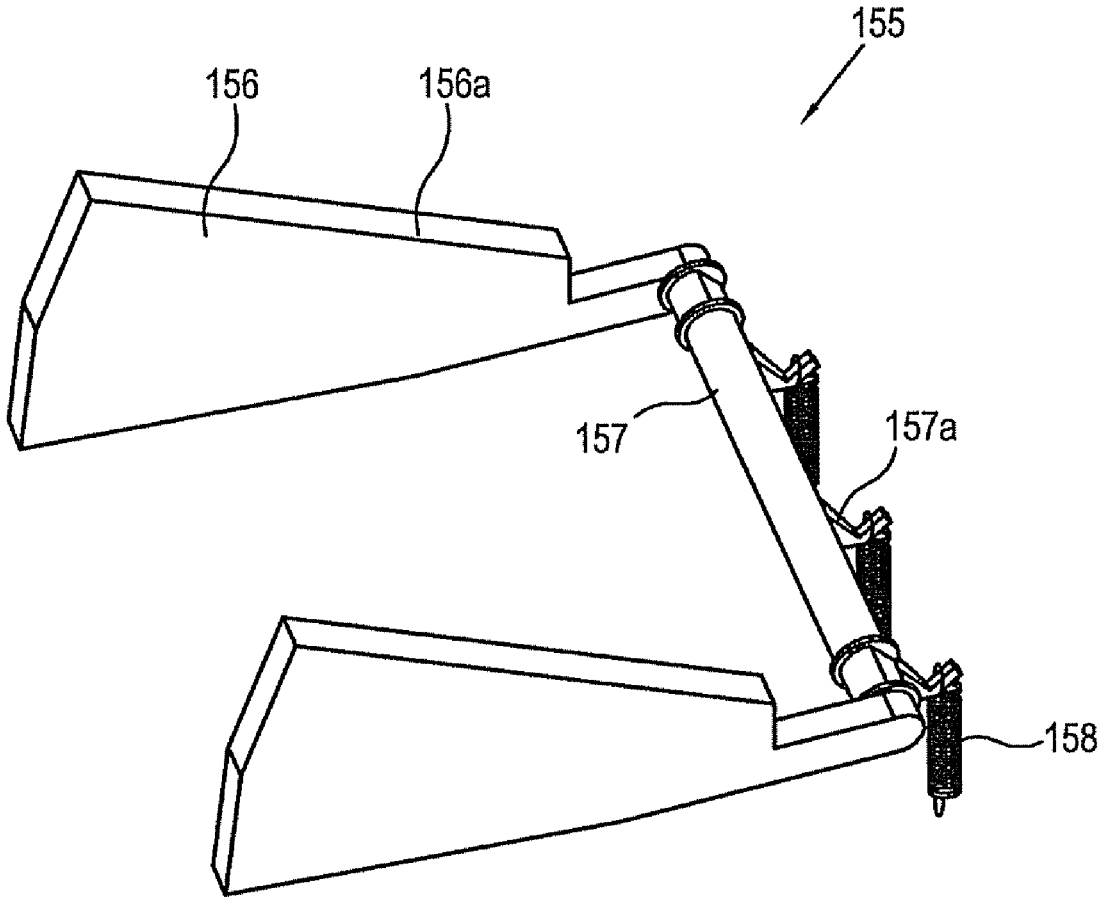
FIG. 4 is a perspective view of a separation preventing unit in FIG. 3.

As shown in FIG. 4, the separation preventing unit 155 includes: the separation preventing wing 156; a shaft 157, which rotatably supports the separation preventing wing 156 with respect to the casing 110; and the elastic member 158, which elastically adjusts the protrusion of the separation preventing wing 156, depending on a weight of the stored printing media in the storage plate 152, i.e., according to the amount of the printing media in the storage plate 152.

The separation preventing wing 156 is provided in the end part of the storage plate 152, and prevents the printing media discharged from the discharger 111, from being ejected to the outside. If the printing media is not stored in the storage plate 152, the separation preventing wing 156 protrudes to a maximum height, and then gradually descends below the storage plate 152, as the weight of the stored printing media in the storage plate 152 increases.

If protruding from the storage plate 152 to the maximum height, an inclination surface 156*a* of the separation preventing wing 156 is inclined with respect to a surface of the storage plate 152. In this case, the maximum height of the inclination surface 156*a*, from the storage plate 152, is greater than that a distance between the discharger 111 and the storage plate 152.

Generally, the printing media is curled when it is heated by the fusing unit 147. Thus, the printing media is curled when discharged from the discharger 111. When a first printing medium is discharged, the separation preventing wing 156 contacts a front end of the first printing medium, and prevents the first printing medium from being ejected to the outside. Even if a second printing medium is curled and discharged, the second printing medium contacts the inclination surface 156*a* and is stably stored on the first printing medium. That is, the separation preventing wing 156 registers the second and any subsequent printing media, so as to be stored at consistent position.

The shaft 157 rotatably supports the separation preventing wing 156, with respect to the casing 110. The shaft 157 is rotatably coupled with, and disposed inside of, the casing 110. The shaft 157 may include a hook 157*a* to couple with the elastic member 158.

The elastic member 158 is coupled between the shaft 157 and the casing 110, and elastically adjusts the protrusion of the separation preventing wing 156, according to the weight of the printing media on the storage plate 152. The elastic member 158 can be, for example, a coil spring, a torsion spring in an end part of the rotation shaft 157, an elastic band, or any other suitable biasing device.

An exemplary image forming process of the image forming apparatus 100 will be described with reference to FIGS. 2 to 5B.

If a printing signal is supplied, the paper feeding unit 130 supplies the printing media to the image forming unit 140. The image forming unit 140 forms images by applying developer to the printing media. The images formed on the printing media are fused by heat and pressure from a fusing unit 147. The fusing unit 147 can curl the printing media.

The printing media is moved by the discharging roller 151 and discharged through the discharger 111. If the printing media is not stored in the storage plate 152, as shown in FIG. 5A, the separation preventing wing 156 protrudes to the maximum height, and contacts the front end of a first sheet of the printing media discharged from the discharger 111, to prevent the printing medium from being ejected. If a subsequent printing medium is discharged, the elastic member 158 is extended, due to the weight of the stored printing media, and the shaft 157 rotates as shown in FIG. 5B. Accordingly, the separation preventing wing 156 descends below the storage plate 152, and the height thereof decreases with respect to the storage plate 152.

As an amount of the stored printing media on the storage plate 152 increases, the height of the stored printing media decreases. Thus, as the height of the separation preventing wing 156 decreases, the separation preventing wing 156 continues to prevent subsequent printing media from being ejected, and prevents registration errors the stored printing media.

As the separation preventing wing 156 descends, the stored amount of the printing media gradually increases. That is, when the separation preventing wing 156 protrudes to the maximum height from the storage plate 152, the height of the storage space of the printing media is h2, as shown in FIG. 2. However, if the stored amount of the printing media increases, the separation preventing wing 156 descends into the storage plate 152, thereby increasing the height of the storage space to a height h3.

If the printing media is removed from the storage plate 152, the elastic member 158 contracts, and the separation preventing wing 156 protrudes again from the storage plate 152, as shown in FIG. 5A.

As described above, the aspects of present invention provide a discharge unit, which adjusts a separation preventing wing, according to an amount of stored printing media, even if a discharger is positioned higher than a storage plate. Aspects of the present invention provide an image forming apparatus having the discharge unit.

Aspects of the present invention provide a discharging unit, which prevents a curled printing medium from being ejected and prevents registration errors in the curled printing medium, by adjusting a height of a separation preventing wing, according to an amount of the printing media. Aspects of the present invention provide an image forming apparatus having the discharging unit.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. A discharging unit to discharge printing media, comprising:

a casing;

a discharger disposed in the casing, to discharge the printing media;

a storage plate which is disposed in the casing below the discharger, to store the printing media discharged from the discharger;

at least one separation preventing wing coupled to the casing, in order to prevent the printing media from being ejected from the storage plate;

a shaft having a first end and a second end opposing the first end and rigidly connected to the at least one separation preventing wing, the shaft to rotate in connection with the at least one separation preventing wing such that the at least one separation preventing wing selectively protrudes from the storage plate; and an elastic member to adjust a protrusion level of the separation preventing wing, by rotating the shaft, according to a weight of the stored printing media, wherein at least one opening is formed on the storage plate and the at least one separation preventing wing protrudes and withdraws through the at least one opening, and wherein the elastic member is disposed inside the casing.

2. The discharging unit according to claim 1, wherein the shaft further comprises a hook to connect to the elastic member.

3. The discharging unit according to claim 1, wherein a maximum protruding distance of the separation preventing wing, with respect to the storage plate, is greater than a distance between the storage plate and the discharger.

4. The discharging unit according to claim 1, wherein the separation preventing wing comprises an inclination surface to register the printing media on the storage plate.

5. The discharging unit according to claim 4, wherein a maximum distance between the inclination surface and the storage plate is greater than a distance between the discharger and the storage plate.

6. An image forming apparatus, comprising:

an image forming unit to form images on printing media;

a paper feeding unit to supply the printing media to the image forming unit; and a discharging unit to discharge and store the printing media from the image forming unit, wherein the discharging unit comprises:

a casing;

a discharger disposed on the casing, to discharge the printing media;

a storage plate disposed below the discharger, to store the printing media discharged by the discharger;

at least one separation preventing wing coupled to the casing, in order to prevent the printing media from being ejected from the storage plate;

a shaft having a first end and a second end opposing the first end and rigidly connected to the at least one separation preventing wing, the shaft to rotate in connection with the at least one separation preventing wing such that the at least one separation preventing wing selectively protrudes from the storage plate; and an elastic member to adjust a protrusion level of the separation preventing wing, by rotating the shaft, according to a weight of the stored printing media, wherein at least one opening is formed on the storage plate and the at least one separation preventing wing protrudes and withdraws through the at least one opening, and wherein the elastic member is disposed inside the casing.

7. The image forming apparatus according to claim 6, wherein the separation preventing wing comprises an inclination surface to register the printing media discharged from the discharger.

8. The image forming apparatus according to claim 7, wherein a maximum distance between the inclination surface and the storage plate is greater than a distance between the discharger and the storage plate.

9. The image forming apparatus according to claim 8, further comprising at least one of:

a scanning unit disposed on the casing, to scan a document to generate image data; and a copy unit to transcribe the image data to the printing media.

10. A discharging unit to discharge printing media, comprising:

a casing;

a discharger disposed in the casing, to discharge the printing media;

a storage plate which is disposed in the casing below the discharger, to store the printing media discharged from the discharger;

first and second wings to selectively protrude from the storage plate, in order to register the printing media;

a shaft, having a first end and a second end opposing the first end, to rotate in connection with the first and second wings such that the first and second wings selectively protrude from the storage plate, the first end of the shaft being rigidly connected to the first wing and the second end of the shaft being rigidly connected to the second wing; and an elastic member to rotate the shaft according to a weight of the stored printing media, wherein at least one opening is formed on the storage plate and the first and second wings protrude and withdraw through the at least one opening, and wherein the elastic member is disposed inside the casing.

11. The discharging unit according to claim 10, wherein the elastic member rotates the shaft, such that a distance between the printing media and the storage plate is greater than a distance between the discharger and the storage plate.

12. The discharging unit according to claim 10, wherein the first and second wings have surfaces to register the printing media, which are inclined with respect to the storage plate when the first and second wings protrude from the storage plate.

* * * * *